US007009132B1

(12) United States Patent
Shea et al.

(10) Patent No.: US 7,009,132 B1
(45) Date of Patent: Mar. 7, 2006

(54) TERMINAL ASSEMBLY FOR VENTED CIRCUIT BREAKER AND CIRCUIT BREAKER INCORPORATING SAME

(75) Inventors: John J. Shea, Pittsburgh, PA (US); Yu Wei Chou, Moon Township, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/933,968

(22) Filed: Sep. 3, 2004

(51) Int. Cl.
*H01H 33/02* (2006.01)

(52) U.S. Cl. ..... 218/155; 218/35; 218/157

(58) Field of Classification Search ..... 218/155–157, 218/34–37, 76, 77; 200/293–306; 335/201, 335/202
See application file for complete search history.

(56) References Cited

U.S. PATENT DOCUMENTS

| | | | | |
|---|---|---|---|---|
| 3,210,504 A | | 10/1965 | Latour | |
| 3,440,378 A | | 4/1969 | Baird | |
| 4,598,186 A | | 7/1986 | Cook et al. | |
| 4,620,076 A | | 10/1986 | Mrenna et al. | |
| 4,631,376 A | | 12/1986 | Leone | |
| 4,650,940 A | | 3/1987 | Grunert et al. | |
| 5,153,545 A | | 10/1992 | Ferullo et al. | |
| 5,206,789 A | * | 4/1993 | Barbry | 335/202 |
| 5,317,117 A | | 5/1994 | Bruski et al. | |
| 5,493,092 A | | 2/1996 | Rowe | |
| 5,498,847 A | | 3/1996 | Bennett et al. | |
| 5,539,170 A | | 7/1996 | Palmer et al. | |
| 5,753,877 A | | 5/1998 | Hartzel et al. | |
| 5,753,878 A | | 5/1998 | Doughty et al. | |
| 6,002,313 A | | 12/1999 | Mrenna et al. | |
| 6,084,188 A | * | 7/2000 | Mueller et al. | 200/305 |
| 6,211,759 B1 | * | 4/2001 | Little et al. | 335/202 |
| 6,407,354 B1 | | 6/2002 | Turner et al. | |
| 6,479,781 B1 | | 11/2002 | Bagepalli et al. | |
| 6,624,375 B1 | * | 9/2003 | Leone et al. | 218/155 |
| 6,838,962 B1 | * | 1/2005 | Leone et al. | 335/202 |

* cited by examiner

*Primary Examiner*—Elvin Enad
*Assistant Examiner*—M. Fishman
(74) *Attorney, Agent, or Firm*—Martin J. Moran

(57) ABSTRACT

A circuit breaker vents at least some of the arc gases generated during current interruption from an internal cavity containing separable contacts through a terminal recess vent in a wall in the housing into an external terminal recess. The line side main conductor extends through the same wall into the external terminal recess adjacent the vent and into the collar of a terminal assembly. An electrically conductive stand seated on the main conductor electrically connects to the main conductor an external conductor clamped against the stand by a terminal screw threaded through the collar. The stand has a through opening aligned with the terminal recess vent to pass the arc gases through the external terminal recess to atmosphere.

3 Claims, 3 Drawing Sheets

TERMINAL ASSEMBLY FOR VENTED CIRCUIT BREAKER AND CIRCUIT BREAKER INCORPORATING SAME

BACKGROUND OF THE INVENTION

1. Field of the Invention

This invention relates to circuit breaker and more particularly to extinguishing arcs generated during high current interruption through a terminal assembly that improves arc gas discharge.

2. Background Information

The current interruption capability of air circuit breakers is dependent in part upon their ability to extinguish the arc that is generated when the circuit breaker main contacts open. Even though the contacts separate, current continues to flow through the ionized gases formed by vaporization of the contacts and surrounding materials. The arc is extinguished through transfer to a set of stacked metal plates in an arc chute that break the arc into a series of arcs, thereby raising the electrical resistance of the arc with a commensurate increase in arc voltage and a reduction in arc current. The arc is also cooled by the flow of the arc gases induced by venting and through vaporization of the metal arc plates and surrounding materials. In the typical circuit breaker, some of the arc gases are reflected off walls of the circuit breaker housing, which slows arc transfer from the contacts to the arc chute and reduces the discharge rate of arc gases from the circuit breaker. Limitations on venting of the arc gases can raise the internal pressure beyond the limits of the breaker housing, thereby restricting the current interruption capability of the breaker. Venting of the arc gases has been hindered by the location of terminals through which the main conductors of the circuit breaker are connected to external conductors of the distribution system for which the circuit breaker provides protection.

There is a need therefore for an improved circuit breaker and a terminal assembly therefor that enhances the rate of discharge of arc gases to improve the current interruption capabilities of the circuit breaker.

SUMMARY OF THE INVENTION

This need and others are satisfied by the invention, which improves the discharge rate of arc gases from circuit breakers, thereby providing the capability of increasing the current interruption rating, and or, reducing the size of the circuit breaker for a given current interruption rating.

In accordance with aspects of the invention, the discharge rate of arc gases is increased by an arrangement that permits venting of at least some of the arc gases through the external conductor terminations. More particularly, the invention is directed to a circuit breaker constructed for connection to an external line conductor that comprises: a housing having an internal cavity and an external cavity recess separated by a wall having at least a first vent opening. Separable contacts are contained in the internal cavity, including a fixed contact to which is connected a main conductor extending through the wall and into the external terminal recess. An arc chute in the internal cavity disposed between the separable contacts and the wall in the housing extinguishes the arc generated during opening of the separable contacts which generates arc gases. A terminal assembly seated in the external recess comprises a terminal collar into which the line conductor extends. An electrically conductive stand is received in the collar and seated on the line conductor. This electrically conductive stand has a transverse through opening aligned with the first vent opening in the wall of the circuit breaker housing through which the arc gases escape. A terminal screw threaded through the collar clamps the external conductor down against the electrically conductive stand to electrically connect the external conductor with the main conductor of the circuit breaker.

Preferably, the transverse through opening in the electrically conductive stand has a cross sectional area that is greater than the cross sectional area of the first vent to maximize the passage of arc gases from the first vent through the electrically conductive stand thereby minimizing the possibility of flashover. The electrically conductive stand can have a tapped bore in a bottom wall below the transverse through opening that is aligned with a through bore in the main conductor. The terminal collar has a base wall with a through hole aligned with the through bore and a retainer screw extends through the through hole in the through bore and engages the threaded bore in the bottom wall of the electrically conductive stand to mechanically secure the collar in the electrically conductive stand to the main conductor of the circuit breaker. The transverse bore opening through the electrically conductive stand can be lined with an electrically insulative material and/or an electrically insulative barrier can be provided around the terminal collar to further minimize the possibility of flashover.

In accordance with another aspect of the invention, the arc chute has a plurality of arc plates extending from adjacent separable contacts toward the wall between the internal cavity and the external terminal recess and an arc runner extends from adjacent the fixed contact toward the wall and the first vent opening. In accordance with another aspect of the invention, the terminal collar extends adjacent an outer surface of the wall of the housing between the internal cavity and the external terminal recess and an arc passage extends along the inner surface of this wall to a second vent opening beyond the terminal collar.

The invention also embraces a terminal assembly for a circuit breaker having a housing with an external terminal recess and a vent opening for discharging arc gases into the terminal recess and a main conductor extending out of the housing adjacent the vent opening and into the terminal recess for connection to an external conductor. This terminal assembly comprises a terminal collar in the external terminal recess through which the main conductor extends. An electrically conductive stand is positioned in the collar with the first surface in contact with the main conductor and having a transverse through opening aligned with the vent opening in the housing. A terminal screw threaded through the terminal collar toward the main conductor clamps the external conductor against a second surface of the electrically conductive stand opposite the first surface, whereby arc gases discharged through the vent opening pass through the transverse through opening in the electrically conductive stand between the main conductor and the external conductor. The electrically conductive stand can have a tapped bore in the first surface and a retainer screw can extend through the collar and main conductor into the tapped bore to secure the terminal collar to the main conductor. In accordance with still another aspect of the invention, the cross sectional area of the transverse through opening in the electrically conductive stand is made larger than the cross sectional area of the vent in the housing wall. Also, the transverse through opening in the electrically conductive stand can be lined with an electrically insulative material to reduce flashover.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
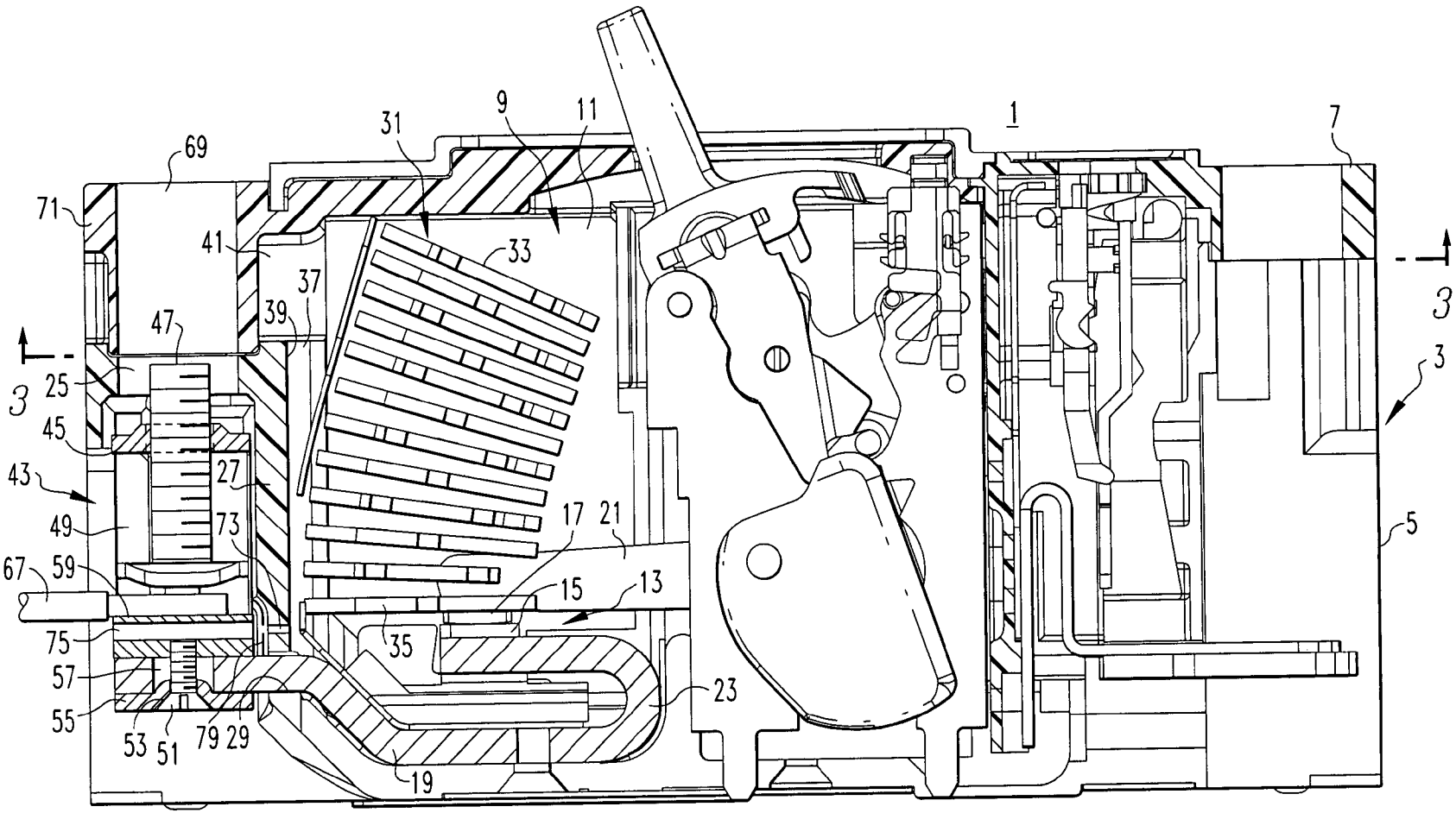
FIG. 1 is a longitudinal section through a circuit breaker in accordance with the invention.

Referring to FIG. 1, a circuit breaker 1 has a molded housing 3 having a base 5 and cover 7. The particular circuit breaker 1 is a three pole breaker. Accordingly, the housing 3 has for each pole 9 an internal contact cavity 111 containing separable contacts 13 including a fixed contact 15 and a movable contact 17. The fixed contact 15 is mounted on a line side main conductor 19 while the movable contact 17 is mounted on the free end of a pivotally mounted contact arm 21. The contact arms 21 of all of the poles 9 are simultaneously rotated from a closed position in which the separable contacts are closed shown in FIG. 1 to an open position (not shown) by an operating mechanism (not shown) in a well known manner. The line side main conductor 19 is formed with a reverse loop 23 to generate repulsion forces between the oppositely flowing currents in the reverse loop 23 and the contact arm 21 to aid in rapid opening of the separable contacts in response to high overcurrents, again as is well known.

The circuit breaker 1 also has for each pole 9 an external terminal recess 25 that is separated from the corresponding internal cavity 11 by a wall 27. The line side main conductor 19 extends from the fixed contact 15 through an opening 29 in the wall 27 into the corresponding external terminal recess 25.

As is conventional, an arc chute 31 is provided in the internal cavity 11 for each pole 9 to assist in extinguishing arcs that are formed between the fixed contact 15 and movable contact 17 but during interruption of current by opening of the separable contacts 13. The arc chute 31 includes a stack of spaced apart arc plates 33 and an arc runner 35 that helps to transfer an arc that forms when the separable contacts 13 open from the contacts to the arc plates which divide the arc into a series of arcs, thereby raising the arc voltage and decreasing arc current to assist in extinguishing the arc. Arc gases generated through vaporization of the contact material, the arc plates and the walls of the internal cavity 11 also help to cool and thereby extinguish the arc. These gases must be vented from the internal cavity 11 both to promote extinguishment of the arc and to preclude overpressurization of the housing 3. As is conventional, the arc plates 33 extend from adjacent the separable contacts 13 toward the wall 27 but terminate short of the wall to form an arc gas passage 37 that extends upward along an inner surface 39 of the wall 27 to a main vent 41 formed in the cover 7 above the terminal assembly 43. Typically, the arc gases are vented from the internal cavity 11 in this manner to avoid passing through the external terminal recess 25 where they might cause flashover.

Figure 2:
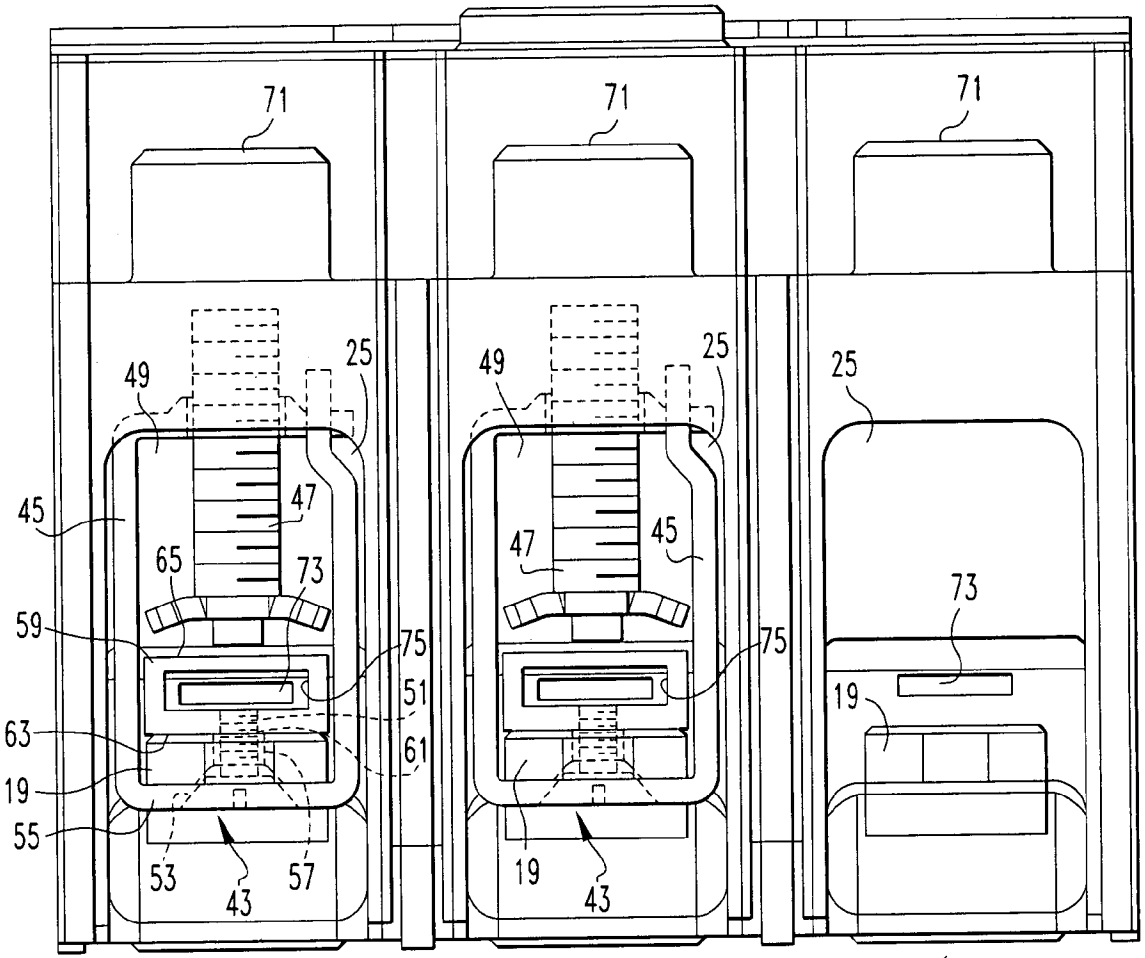
FIG. 2 is an end elevation view of the circuit breaker of FIG. 1.
Figure 4:
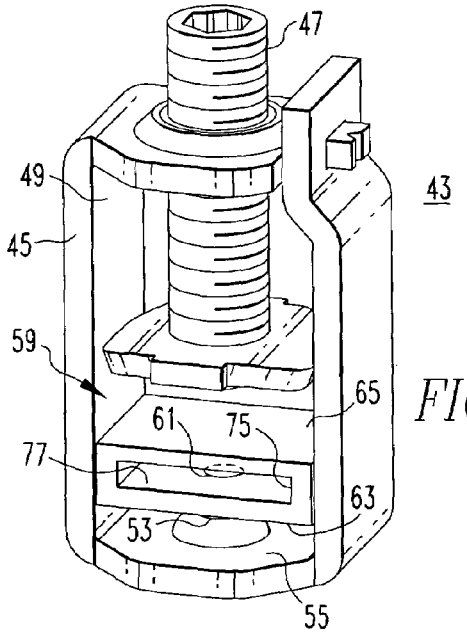
FIG. 4 is an exploded isometric view of a terminal assembly which forms part of the circuit breaker of FIGS. 1 and 2.

In accordance with aspects of the invention, some of the arc gases are exhausted through the external terminal recess 25. This is made possible by a novel terminal assembly 43. As best seen in FIG. 4, the terminal assembly 43 includes a terminal collar 45 and a terminal screw 47 that extends transversely across a generally rectangular opening 49 in the terminal collar 45. As can been seen for the left two poles 9 in FIG. 2, the terminal collar 45 for each pole is seated in the corresponding external terminal recess 25 with the main conductor 19 extending through the opening 49. The terminal collar 45 is retained in place on the main conductor 19 by a retainer screw 51 that extends through a through hole 53 in the base wall 55 of the terminal collar and through a through bore 57 in the main conductor 19.

Figure 3:
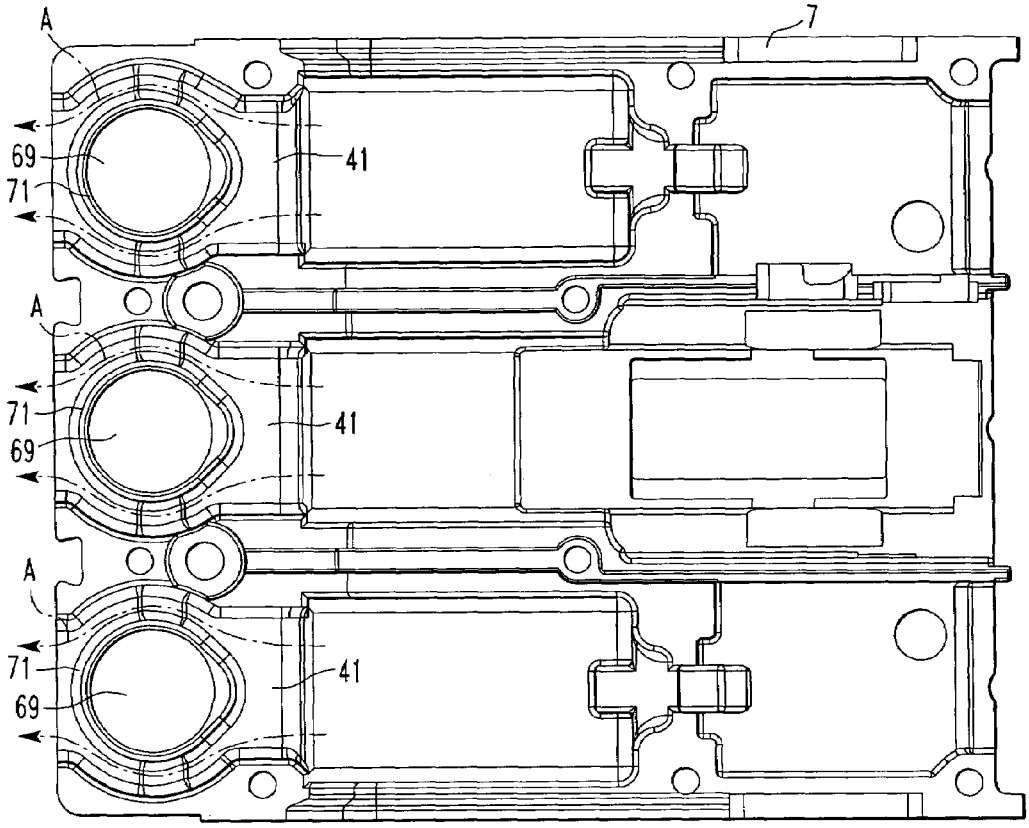
FIG. 3 is a plan view of the underside of the cover which forms part of the circuit breaker of FIGS. 1 and 2.

In prior practice, the retainer screw 51 was threaded into a steel nut provided on top of the main conductor 19. In accordance with aspects of the invention, this steel nut is replaced by an electrically conductive, e.g., copper, stand 59, which has a threaded bore 61 in a bottom or first surface 63 of the stand to secure the terminal collar 45 on the main conductor 19. The stand has a second or upper surface 65 against which the terminal screw 47 clamps an external conductor 67 to mechanically and electrically, through the stand 59, connect the external conductor 67 (see FIG. 1) to the main conductor 19. The terminal screw 47 is accessible through an opening 69 in the cover 7 that runs transversely through the main gas vent 41. As can been seen in the bottom plan view of the cover 7 in FIG. 3, this passage 69 is formed by a generally annular protrusion 71 molded in the cover 7. The gases vented through the main vent 41 flow around the annular protrusion 71 as shown by the arrows A.

In accordance with aspects of the invention, additional venting of the arc gases from the internal cavity 11 is provided by a terminal recess vent opening 73 in the wall 27 between the internal cavity 11 and the external terminal recess 25. This terminal recess vent opening 73 in the exemplary embodiment is located adjacent the termination of the arc runner 35 and above the opening 29 in the wall 27 for the main conductor 19. The stand 59 has a transverse through opening 75 that is aligned with the terminal recess vent opening 73 in the wall 27. Preferably, the cross-sectional area of the transverse through opening 75 in the stand 59 is greater than the cross-sectional area of the terminal recess vent opening 73 to promote the flow of arc gases through the stand 59. In the exemplary embodiment, the stand 59 is positioned against the wall 27 to promote the flow of gasses through the opening 75 rather than around the edges of the stand 59. In accordance with other aspects of the invention, the transverse through opening 75 can be aligned with an electrically insulative material 77, which can be applied as a spray, coating, a separate insert or the like. Other surfaces of the stand 59 could also be covered with an electrically insulative material, except for the bottom and upper surfaces 63 and 65 which must remain electrically conductive to connect the external conductor 67 with the main conductor 19. If need be, additional or other insulative materials such as fish paper (79), could be used around the terminal assembly to reduce the possibility of flashover.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A circuit breaker constructed for connection to an external conductor, the circuit breaker comprising:

a housing having an internal cavity and an external terminal recess separated by a wall having at least a first vent opening;

separable contacts in the internal cavity including a fixed contact and a movable contact;

a main conductor extending from the fixed contact in the internal cavity through the wall into the external terminal recess;

an arc chute in the internal cavity between the separable contacts and the wall in which an arc generated during opening of the separable contacts is extinguished with the generation of arc gases;

a terminal assembly seated in the external terminal recess and comprising:

a terminal collar into which the main conductor extends;

an electrically conductive stand received in the terminal collar and seated on the main conductor, the electrically conductive stand having a transverse through opening aligned with the first vent opening in the wall through which the arc gases escape the housing;

a terminal screw threaded through the terminal collar to clamp the external conductor against the electrically conductive stand to electrically connect the external conductor with the main conductor;

wherein the electrically conductive stand has a tapped bore in a bottom face below the through opening aligned with a through bore in the main conductor and the terminal collar has a base wall with a through hole aligned with the through bore, and wherein the terminal assembly further includes a retainer screw extending through the through hole and the through bore and engaging the threaded bore in the electrically conductive stand to mechanically secure the terminal collar and the electrically conductive stand to the main conductor; and wherein the transverse through opening in the electrically conductive stand is lined with an electrically insulative material.

2. A terminal assembly for a circuit breaker having a housing with an external terminal recess and a vent opening for discharging arc gases into the terminal recess, and a main conductor extending out of the housing adjacent the vent opening and into the external terminal recess for connection to an external conductor, the terminal assembly comprising:

a terminal collar in the external terminal recess through which the main conductor extends;

an electrically conductive stand positioned in the terminal collar with a first surface in contact with the main conductor and having a transverse through opening aligned with the vent opening in the housing;

a terminal screw threaded through the terminal collar toward the main conductor to clamp the external conductor against a second surface on the electrically conductive stand opposite the first surface, whereby arc gas discharged through the vent opening passes through the transverse opening in the electrically conductive stand between the main conductor and the external conductor;

wherein the electrically conductive stand has a tapped bore in the first surface and a retainer screw extends trough the terminal collar and the main conductor into the tapped bore to secure the terminal collar to the main conductor;

wherein the through opening in the electrically conductive stand has a cross sectional area that is greater than a cross sectional area of the vent opening; and wherein the through opening in the electrically conductive stand is lined with an electrically insulative material.

3. A terminal assembly for a circuit breaker having a housing with an external terminal recess and a vent opening for discharging arc gases into the terminal recess, and a main conductor extending out of the housing adjacent the vent opening and into the external terminal recess for connection to an external conductor, the terminal assembly comprising:

a terminal collar in the external terminal recess through which the main conductor extends;

an electrically conductive stand positioned in the terminal collar with a first surface in contact with the main conductor and having a transverse through opening aligned with the vent opening in the housing;

a terminal screw threaded through the terminal collar toward the main conductor to clamp the external conductor against a second surface on the electrically conductive stand opposite the first surface, whereby arc gas discharged through the vent opening passes through the transverse opening in the electrically conductive stand between the main conductor and the external conductor; and wherein the transverse through opening in the electrically conductive stand is lined with an electrically insulative material.

* * * * *